United States Patent [19]

McCoy

[11] 4,237,438

[45] Dec. 2, 1980

[54] HIGH RESISTANCE CONTINUOUS SHIELD FOR REDUCED CAPACITIVE COUPLING IN A DEFLECTION YOKE

[75] Inventor: John F. McCoy, Haddonfield, N.J.

[73] Assignee: RCA Corporation, New York, N.Y.

[21] Appl. No.: 971,035

[22] Filed: Dec. 19, 1978

[51] Int. Cl.[3] ..... H01F 3/00

[52] U.S. Cl. ..... 335/214; 335/301

[58] Field of Search ..... 335/301, 214; 174/35 CE, 35 MS; 336/84 R, 84 C

[56] References Cited

U.S. PATENT DOCUMENTS

| | | | |
|---|---|---|---|
| 2,026,060 | 12/1935 | Pratt | 174/35 MS |
| 2,490,731 | 12/1949 | Goodale et al. | 250/157 |
| 2,568,456 | 9/1951 | Malheiros | 313/76 |
| 2,845,562 | 7/1958 | Bendell et al. | 313/76 |
| 3,551,718 | 12/1970 | Bossers | 313/479 |
| 3,601,648 | 8/1971 | Uno | 313/64 |
| 4,152,745 | 5/1979 | Eul | 335/214 |

*Primary Examiner*—Harold Broome

*Attorney, Agent, or Firm*—Eugene M. Whitacre; Paul J. Rasmussen; Scott J. Stevens

[57] ABSTRACT

Capacitive coupling between coils of an electron beam deflection yoke and between coils and the electron tube is reduced by electrostatic shields. The shields are continuous for best shielding. Eddy currents flow in the shield resulting from the magnetic beam deflection fields results in field distortion and power loss. The eddy current flow and the power loss are reduced by using a nickel chromium alloy material for the shield.

4 Claims, 2 Drawing Figures

HIGH RESISTANCE CONTINUOUS SHIELD FOR REDUCED CAPACITIVE COUPLING IN A DEFLECTION YOKE

BACKGROUND OF THE INVENTION

This invention relates to high resistance electrostatic shielding between elements of a deflection yoke and between the deflection yoke and the electron gun elements within a vacuum tube whose electron beam is being deflected.

In a television camera, a deflection yoke including deflection windings is used in combination with each pickup tube to repetitively deflect an electron beam across the surface of a photosensitive target (or conductor). Similarly, in television receivers, a deflection yoke is used in combination with a cathode ray tube to repetitively deflect an electron beam (or beams) across a photoemissive surface.

It is undesirable to have capacitive coupling between the deflection windings and the electron gun elements of the camera pickup tube because, in spite of the presence of by-pass capacitors connecting the electron gun elements to ground, the large voltage pulses associated with the deflection windings (especially the line-rate pulses) will be coupled to, and will produce small voltages on the electron gun elements. Capacitance between the electron gun elements and the target element will couple those voltages to the target element where they combine with the video target signal. These extraneous pulses could, for example, saturate or over-drive the associated video amplifiers. However, if the pickup tube is electrostatically shielded from the yoke, capacitive coupling between the deflection windings and the electron gun is reduced.

It is also undesirable to have capacitive coupling between the deflection windings and the electron gun elements of a cathode ray tube.

Accordingly, it is common practice to interpose an electrostatic shield of conductive, low permeability material between the deflection windings and the camera or cathode ray tube to prevent an electric field from being established by the deflection yoke near the tube elements or in the region through which the electron beam flows, thereby reducing the capacitive coupling.

It is undesirable to have capacitive coupling between the line-rate windings and the field-rate windings of a deflection yoke because a line-rate component in the field-rate deflection current would produce distortion in the scanning raster. Accordingly, it is common practice to interpose an electrostatic shield of conductive, low permeability material between the line-rate windings and the field-rate windings, thereby reducing the capacitive coupling.

Deflection of an electron beam is accomplished by the magnetic field of the deflection windings. The low-frequency components of the magnetic field pass undistorted through such a low permeability shield, and the beam deflection is not hindered. High-frequency components of the magnetic field, however, cause an induced eddy current to flow through the conductive electrostatic shield. The current flow in the conductive electrostatic shield in turn generates a magnetic field tending to cancel the original field by which the current flow was established. Thus, a conductive electrostatic shield which permits significant eddy current flow (e.g., a continuous sheet or film of aluminum or graphite) would also act to shield the electron beam from high-frequency magnetic deflection components, and would distort the magnetic field.

Eddy currents due to high-frequency components of the magnetic deflection field occurring during the line-rate flyback or retrace interval cause a power loss in such a shield. The result of the power loss is undesired nonlinear deflection versus time in the interval immediately following retrace, in spite of current in the line-rate deflection windings which changes linearly versus time during that interval. This results in an apparent picture expansion on the left side of the raster. In addition, the changes in scanning velocity during that interval cause undesired modulation of the video target signal current.

Efforts to reduce the shielding and power loss effects of the electrostatic shield on the magnetic deflection components have in the past been directed to interrupting the flow of eddy currents in the electrostatic shield by introducing gaps of various sorts in the conductive shield. Such an arrangement is shown in U.S. Pat. No. 3,601,648 issued Aug. 24, 1971 to Uno. The reduction in electrostatic shielding occasioned by these gaps has been corrected by overlapping the shields, as described in U.S. Pat. No. 2,490,731 issued Dec. 6, 1949 to Goodale, et al. Such arrangements are complex and expensive. It is desirable to have an electrostatic shield which is continuous and without gaps, and which provides for low attenuation of high-frequency components of the magnetic deflection fields and low power losses.

SUMMARY OF THE INVENTION

A deflection yoke adapted for deflection of an electron beam includes an electrostatic shield disposed adjacent to a winding for reducing capacitive coupling, wherein the shield is composed of a nickel chromium alloy.

DESCRIPTION OF THE INVENTION

Figure 1:
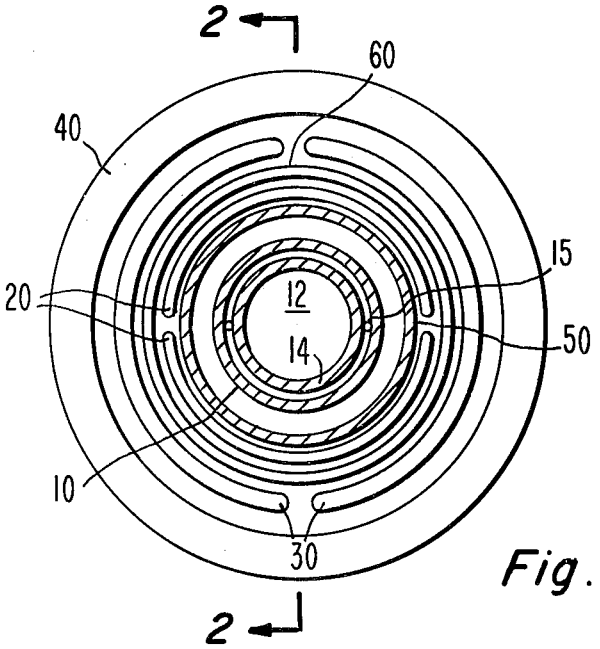
FIGS. 1 and 2 illustrate partial cross-sectional views of a deflection yoke and associated television tube embodying the invention.
Figure 2:
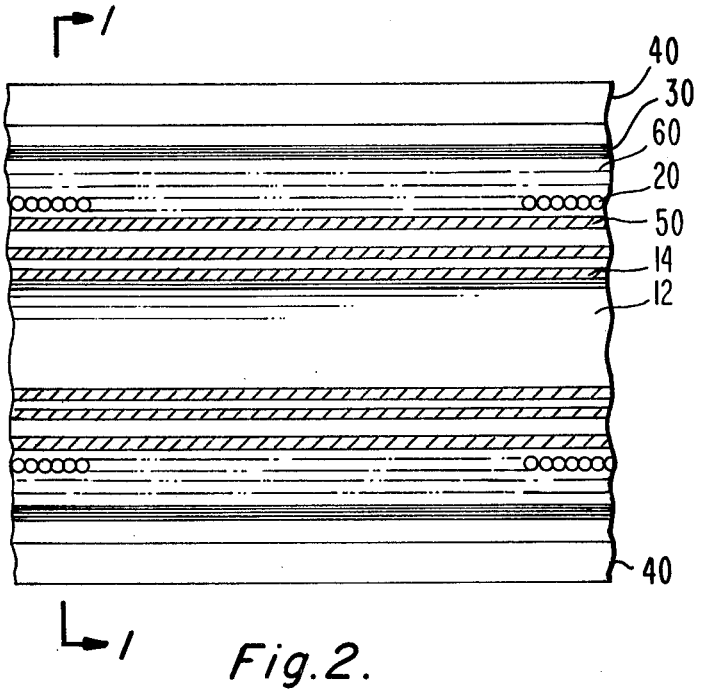

In FIG. 1, a known television tube such as a camera pickup tube has a glass envelope 10 enclosing an electron gun focusing element 14, electron gun connection rods 15, and an evacuated space 12 traversed by an electron beam. (It is of interest to note that nickel chromium alloy material is commonly used for the focusing element of the electron gun in the camera pickup tube because it, also, must exhibit low permeability and present a high resistance to the flow of eddy currents in order to avoid magnetic field distortion and deflection nonlinearity problems). A pair of line-rate deflection coils 20 substantially surround envelope 10 for producing a magnetic field through space 12 for line-rate (e.g., horizontal) beam deflection. A pair of field-rate deflection coils 30 surround line-rate deflection coils 20 for producing a magnetic field orthogonal to that produced by line-rate deflection coils 20 for field-rate (e.g., vertical) deflection of the electron beam. A focus coil 40 surrounds the field-rate deflection coils.

A continuous electrostatic shield 50 is interposed between horizontal deflection coils 20 and envelope 10. Shield 50 is a nickel-chromium alloy foil having a relatively high resistance. A further electrostatic shield 60 is interposed between horizontal deflection coils 20 and vertical deflection coils 30. Shield 60 is also formed from the nickel-chromium alloy foil.

In operation, nickel-chromium alloy shields 50 and 60 present a relatively high resistance path for the eddy currents induced by the line-rate deflection field. The reduction in eddy currents compared with those in a graphite, aluminum or copper shield reduces the power loss during the flyback interval. Reduced power loss improves the linearity of the deflection vs. time in the interval immediately following the flyback interval.

A high-resistance low-permeability nichrome alloy suitable for use as a shielding material has the following composition:

| ELEMENT | % |
|---|---|
| Cr | 19.0–20.0 |
| Fe | 1.0 MAX |
| Mn | 0.25 MAX |
| C | 0.10 MAX |
| Si | 0.45 MAX |
| Al | 0.01 MAX |
| Ni | remainder, which may include a slight amount of cobalt |

A shield made of this material in 0.003 inch (0.075 mm) thickness has been found to have conductivity sufficiently low to reduce eddy currents to an acceptable level. (Thinner material would, of course, provide even lower conductivity.)

This alloy has a nominal resistivity of 108 microohm centimeter at 20° C. and a maximum relative permeability of 1.005 at 20° C.

What is claimed is:

1. A deflection yoke adapted for deflection of an electron beam produced by electron gun apparatus disposed within the interior of a vacuum tube, comprising first and second deflection windings, said first winding disposed between said second winding and said vacuum tube, said yoke including first and second electrostatic shields, said first electrostatic shield disposed between said first deflection winding and said vacuum tube for reducing capacitive coupling between said first deflection winding and said electron gun apparatus, said second electrostatic shield disposed between said first and second deflection windings for reducing capacitive coupling therebetween, wherein the improvement resides in that each of said shields is continuous and exhibits high resistivity and low permeability and is composed of nickel chromium alloy.

2. A deflection yoke according to claim 1 wherein said nickel chromium alloy provides permeability on the order of 1.005 at 20° C. and resistivity on the order of 108 microohm-centimeter at 20° C.

3. A deflection yoke according to claim 1 wherein said nickel-chromium alloy contains from 19 to 20% chromium.

4. A deflection yoke according to claim 1 wherein said nickel-chromium alloy contains from 19 to 20% chromium, a maximum of 1% iron, 0.25% manganese, 0.1% carbon, 0.45% silicon, 0.01% aluminum, and wherein the remainder is nickel.

* * * * *